United States Patent [19]

Kato et al.

[11] Patent Number: 4,935,179

[45] Date of Patent: Jun. 19, 1990

[54] METHOD FOR EXTRUDING CERAMIC BODIES

[75] Inventors: Kiminari Kato; Keiichiro Watanabe, both of Nagoya; Masumi Yokoi, Komaki, all of Japan

[73] Assignee: NGK Insulators, Ltd., Japan

[21] Appl. No.: 166,456

[22] Filed: Mar. 10, 1988

[30] Foreign Application Priority Data

Mar. 19, 1987 [JP] Japan ..... 62-64998

[51] Int. Cl.[5] ..... B28B 21/52

[52] U.S. Cl. ..... 264/40.1; 264/40.7; 264/150; 264/177.11; 264/177.12

[58] Field of Search ..... 264/177.11, 177.12, 264/40.7, 150

[56] References Cited

U.S. PATENT DOCUMENTS

| | | | |
|---|---|---|---|
| 663,141 | 12/1900 | Croft | 264/177.11 |
| 1,500,739 | 7/1924 | Howard et al. | 264/177.11 |
| 2,301,906 | 11/1942 | Miller et al. | 264/148 |
| 3,376,181 | 4/1968 | Larson et al. | 264/150 |
| 3,919,384 | 11/1975 | Cantaloupe | 264/150 |
| 4,178,145 | 12/1979 | Hamamoto et al. | 425/199 |

FOREIGN PATENT DOCUMENTS

| | | |
|---|---|---|
| 1584554 | 2/1970 | Fed. Rep. of Germany . |
| 2844287 | 4/1984 | Fed. Rep. of Germany . |
| 1099519 | 1/1968 | United Kingdom . |

*Primary Examiner*—James Derrington

*Attorney, Agent, or Firm*—Arnold, White & Durkee

[57] ABSTRACT

A method of extruding ceramic bodies in a downward direction is disclosed, which includes the steps of supporting an extruded body being downwardly extruded through an extruding die to prevent deformation of the extruded body, and cutting the extruded body in a given length. An apparatus for effecting this extruding method is also disclosed, which includes an extruding unit provided with a die at a bottom thereof, a unit for holding the extruded body being downwardly extruded, and a cutter for cutting the extruded body in the given length.

2 Claims, 6 Drawing Sheets

METHOD FOR EXTRUDING CERAMIC BODIES

BACKGROUND OF THE INVENTION (1) Field of the Invention

The present invention relates to a method and an apparatus for extruding ceramic bodies with excellent dimensional accuracy.

(2) Related Art Statement

In order to extrude ceramic bodies, there has formerly been used a laterally extruding method in which the ceramic bodies are horizontally extruded. Since the extruded bodies are expediently set in the succeeding steps in the case of the laterally extruding method, this method is functional and effective in view of the entire extruding steps.

For instance, small size ceramic honeycomb structural shaped bodies having a diameter of not more than about 150 mm or a height of not more than about 150 mm when being horizontally extruded have a great cell density with a wall pitch of from 1 to 3 mm, and are light in weight. Thus, they will not deform by their self weight. Accordingly, they can horizontally be extruded.

However, if the above conventional laterally extruding technique is employed for ceramic components, such as ceramic rotors for pressure wave type superchargers, which have a relatively heavy weight and a smaller cell density, the extruded bodies deform due to their self weight until they are extruded from a die in a given length. Consequently, ceramic extruded products having excellent dimensional accuracy could not be obtained.

Also, since the self weight of large size ceramic honeycomb structural bodies having a diameter of more than 150 mm or a height of more than 150 mm when being horizontally extruded exceed their strength in the case of the lateral extruding, the extruded bodies deform due to their self weight so that products having excellent dimensional accuracy cannot be obtained.

On the other hand, there is also known a method of extruding ceramic bodies in an upward direction. In this upward extruding method, bending of extruded bodies is corrected by hands during extrusion, and the extruded bodies are taken out by using a jig. Thus roundness is outside a range of $\pm 1.0$ mm and a bending amount is 1.0 mm or more (Here, the roundness means a larger value between measured differences from the maximum diameter to the minimum diameter at each of opposite end faces in the case of an extruded body having a round section and the bending amount does the maximum distance l between a dried body 20 having a length of 150 mm and a base plate 21 placing the body 20 thereon as shown in FIG. 7).

SUMMARY OF THE INVENTION

Therefore, it is an object of the present invention to provide a method and an apparatus for extruding ceramic bodies, which solve the problems encountered by the conventional lateral extruding method and upward extruding method.

The present invention relates to a method for extruding a ceramic body in a downward direction, and is characterized in that the extruded body being downwardly extruded through an extrusion die is supported so that the extruded bodies may be prevented from deforming, and is cut in a given length.

The present invention also relates to the apparatus for downwardly extruding a ceramic body, which comprises an extruding unit provided with an extruding die at its bottom, a holding unit for holding or supporting an extruded body being extruded downwardly, and a cutter.

In the above-mentioned construction, extruded body is preferably held by the following holding method and holding unit. That is, the extruded body being extruded downwardly is held at its outer peripheral face in a radially inside direction. The holding unit is designed to effect such a holding method. In the alternative, while the extruded length of the body being extruded or a value in proportion to the extruded length of the extruded body is measured, a reaction force consisting of a force in proportion to the extruded length and a holding force is upwardly applied to the lower end of the extruded body, and the holding unit is designed to effect such a method.

These and other objects, features and advantages of the present invention will be appreciated upon reading of the following description of the invention when taken in conjunction with the attached drawings, with the understanding that some modifications, variations and changes of the same could be made by the skilled person in the art to which the invention pertains without departing from the spirit of the invention or the scope of claims appended hereto.

BRIEF DESCRIPTION OF THE ATTACHED DRAWINGS

For a better understanding of the invention, reference is made to the attached drawings, wherein.

DETAILED DESCRIPTION OF THE INVENTION

An example of the construction of the present invention will be explained based on a preferred embodiment shown in FIG. 1.

Figure 1:
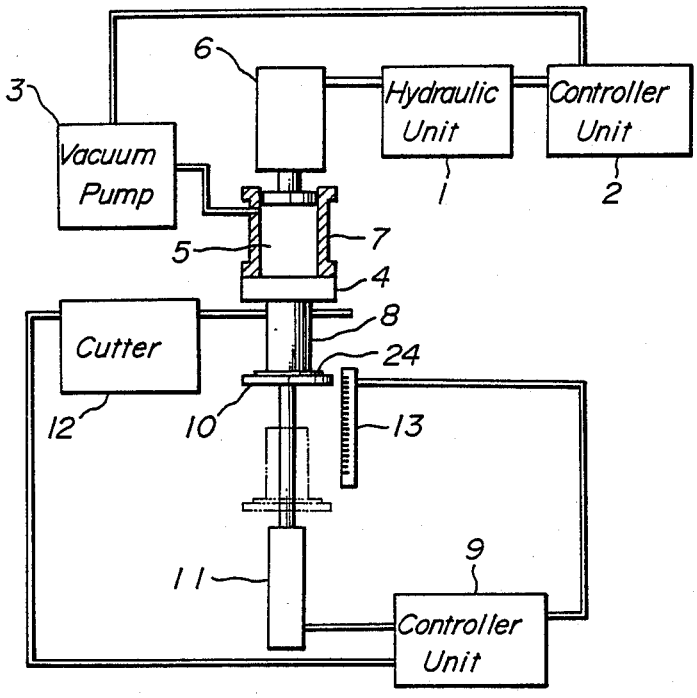
FIG. 1 is a schematic view of an embodiment of the ceramic material extruding apparatus according to the present invention.

FIG. 1 is a schematic view showing an embodiment of an apparatus for extruding ceramic bodies according to the present invention. A ceramic billet 5 is downwardly extruded through a die nozzle 4 by a push force of a plunger 6 from a cylinder 7 which is reduced in pressure by a vacuum pump 3. In this case, the push force of the plunger 6 is appropriately determined by a hydraulic pressure of a hydraulic unit 1 which is controlled by a controller unit 2. The extruded body 8 being downwardly extruded is received by a receiving tray 24 supported by a receiving table 10 at the die surface. At that time, a plunger 11 for the receiving table 10 is so controlled by a controller unit 9 that a reaction force consisting of a force in proportion to the extruded length of the extruded body 8 and a holding force may be applied to the receiving table 10. The term "holding force" is used throughout the specification and claims to mean a force by which the extruded body is fixed to the receiving tray. This holding force is a given pressure upwardly applied to the extruded body. When the shaped body is fixed to the receiving tray by holding the outer peripheral face thereof, the holding force is a pressure to hold the outer peripheral face. The receiving table 10 is descended while the extruded body 8 is supported on the receiving tray 24 on the receiving table 10, thereby shaping the ceramic body in a given length. As mentioned above, a receiving table unit is constituted by the receiving tray 24 for receiving the extruded body 8 from the underside and fixing it, the receiving table 10 supporting the receiving tray 24 from the underside, and the receiving table plunger 11 for ascending and descending the receiving table 10.

Next, the extruded body 8 is cut by a cutter 12 to a given length, and then the receiving table plunger 11 is descended to take the extruded body 8 outside as a green product.

The concrete method of applying the reaction force to the extruded body 8 by the receiving table 10 and the receiving tray 24 via the receiving table plunger 11 will be mentioned later. Fundamentally speaking, the extruded length of the extruded body 8 is measured by an extruded body length-measuring means 13 (which is a magnet scale as a displacement meter in FIG. 1), and the push pressure of the receiving table plunger 11 is appropriately controlled by the controller unit 9 based on the measured length. In this case, the extruded body is well prevented from deforming by applying the reaction force to the receiving table 10 in synchronization with the moving speed of the receiving table 10, that is, the descending speed of the receiving table plunger 11, with the extruding speed of the extruded body 8. It is preferable that a projection is formed on the receiving tray 24 so that the extruded body may be held on the receiving tray to prevent slipping between the receiving tray 24 and the extruded body 8 during the extruding, thereby preventing deformation of the extruded body.

Figure 8:
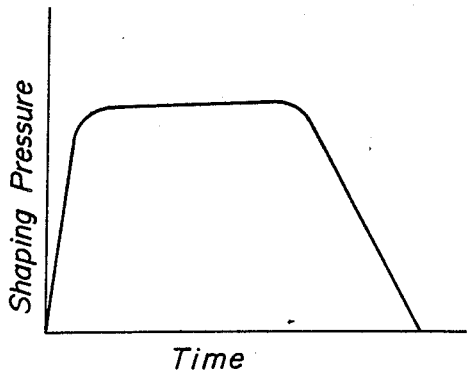
FIG. 8 is a graph showing changes in extruding pressure with the lapse of time.

It is preferable to set the force in proportion to the length of the extruded body and the holding force in a range not exceeding 5 times the weight of the extruded body having said length. The phenomenon that the extruded body deforms due to variation in the extruding pressure as shown in FIG. 8 can be prevented by applying the holding force and the force proportional to the length of the extruded body to the extruded body as the reaction force. Further, the phenomenon that the body being extruded deforms through being pulled near the extruding die surface due to its self weight can simultaneously be prevented.

When the extruded body 8 is to be cut in a given length by the cutter 12, a perpendicularity and a flatness at the end face of the extruded body product relative to the extruding direction can be improved by synchronizing the cutter 12 with the extruding speed of the extruded body 8. Consequently, the lower end face of the extruded body can fully be supported by the receiving tray 24 in the succeeding step, thereby permitting continuous production of extruded bodies while they never fall down. In this case, there is no need to improve the perpendicularity and the flatness by machining the end face again. Therefore, this processing step can be omitted and wasteful portions of the extruded body can be reduced.

The cutting may be effected by the cutter 12 at such a location that the length of the ceramic body 5 extruded downwardly may corresponds to that of one or two extruded bodies 8. The extruded bodies may be continuously produced by alternatively and repeatedly extruding the ceramic body and cutting it in a given length.

Since the ceramic green products having excellent dimensional accuracy may be obtained according to the present invention as mentioned above even if the extruded bodies 8 have a relatively heavy weight and small cell density, the shaped bodies may preferably be used as ceramic rotors for use in pressure wave type superchargers, etc.

The present invention may also be employed for extruding large size ceramic honeycomb structural bodies having a diameter of more than 150 mm or large size ceramic honeycomb structural bodies having a minor axis of more than 150 mm.

Figure 9:
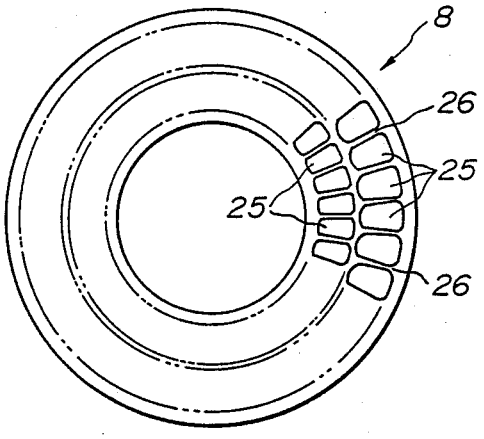
FIG. 9 is an example of ceramic extruded bodies for the production of ceramic rotors to be used in a pressure wave type supercharger.
Figure 10:
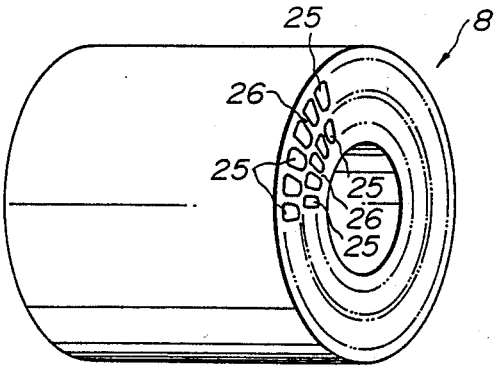
FIG. 10 is a perspective view of the ceramic extruded body shown in FIG. 9.

In FIGS. 9 and 10 are shown an embodiment of a ceramic honeycomb structural body to be used to produce a ceramic rotor for a pressure wave type supercharger. In the illustrated embodiment, the ceramic extruded body 8 for the rotor has a cylindrical shape, as a whole, with a group consisting of through holes 25 arranged in concentrically inner and outer annular rows. The through holes 25 are opened at axially opposed end faces. A reference numeral 26 is a cell wall constituting the through holes 25.

Next, the method of applying the reaction force to the extruded body will be explained.

Figure 2:
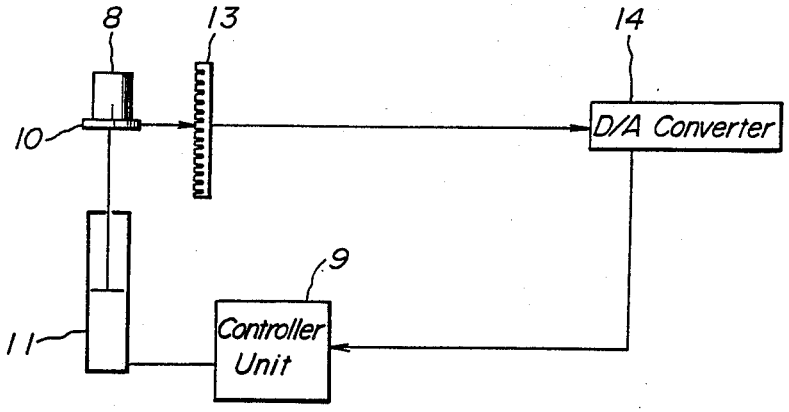
FIG. 2 is a view illustrating a method of generating a reaction force.

In a first method, the reaction force is generated while the length of the extruded body is being measured. As shown in FIG. 2, the location of the receiving table 10 is measured by the displacement meter 13 (for instance, a magnet scale), and a reaction force in proportion to the location of the receiving table 10 (the length of the shaped body) is generated by the pressure of a fluid inside the cylinder of the receiving table plunger 11 based on a control signal from the controller unit 9.

Figure 3:
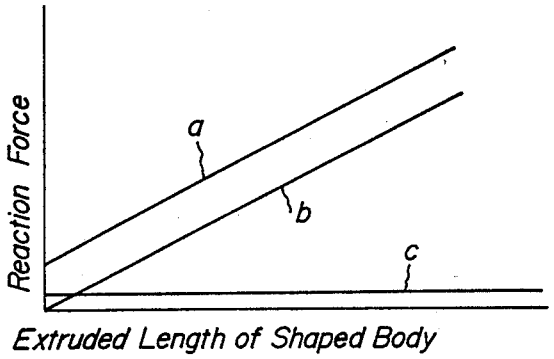
FIG. 3 is a graph showing the relation between the reaction force and the extruded length of an extruded body in the case of FIG. 2.

A reference numeral 14 is a D/A converter which is to convert digital signals to analog signals. The D/A converter converts dimensional data (digital signals) from the magnet scale 13 to analog signals, and feeds the latter signals to the controller unit 9 to control the pressure of the receiving table plunger 11. FIG. 3 shows the relation between the reaction force and the length of the extruded body. As shown in FIG. 3, the holding force may preliminarily be given as the reaction force. That is, a line "a" in FIG. 3 corresponds to a case where the holding force is preliminarily given and the reaction force is given in proportion to the extruded length of the extruded body. A line "b" corresponds to a case where no holding force is preliminarily given. A line "c" is a case where the extruded body is formed while a constant holding force is given. It is preferable to set the maximum value of the reaction force at not more than 5 times the weight of the extruded body of a given length.

Figure 4:
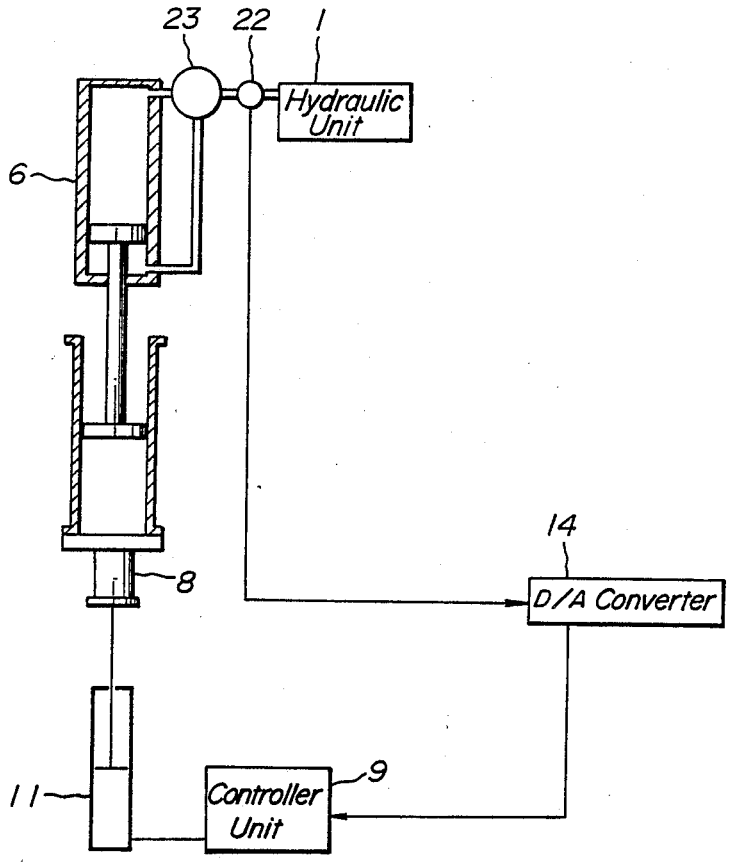
FIG. 4 is a view illustrating another method of generating a reaction force.
Figure 5:
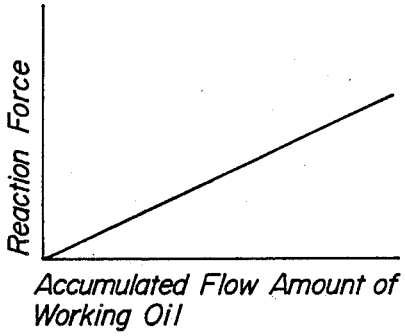
FIG. 5 is a graph showing the reaction between the reaction force and an extruding time in the case of FIG. 4.

In a second method, a reaction force is generated, while a displacement of the plunger is being detected. As shown in FIG. 4, the reaction force is generated by utilizing the fact that the displacement of the plunger 6 is proportional to the extruded length of the extruded body. The displacement of the plunger 6 is detected by measuring the flow amount of a working oil in a hydraulic unit 1 to drive the plunger 6. Therefore, the displacement of the plunger is determined by measuring the flow amount of the working oil, and accordingly the extruded length of the extruded body is detected. Based on the measured extruded length, a reaction force can be generated in proportional to the length of the extruded body. FIG. 5 shows the relation between the reaction force and the accumulated flow amount of the working oil.

In a third method, a force applied to the receiving table 10 is detected, and a force in proportion to the extruded length of the extruded body and a holding force are generated. In this case, the reaction force is applied by a servomotor 16 through a load cell 15 and a ball screw 17 instead of the magnet scale as means for measuring the extruded length of the extruded body and the receiving table plunger 11 for applying the reaction force in FIG. 2. This method as a matter of course falls inside the scope of the present invention.

Figure 6:
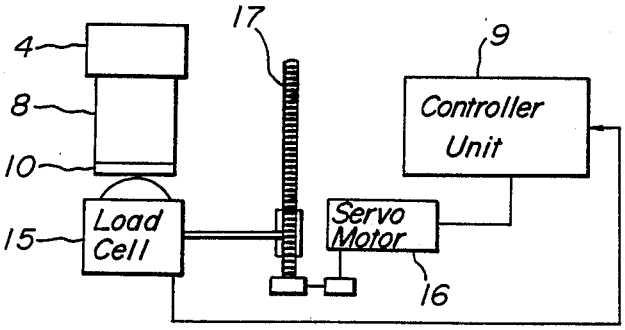
FIG. 6 is a view illustrating still another method of generating a reaction force.
Figure 7:
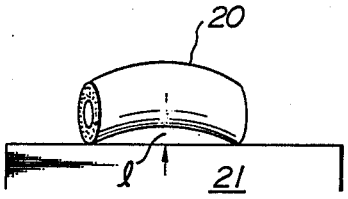
FIG. 7 is a view illustrating definition of the bended amount of the extruded body.

As shown in FIG. 6, according to this method, a force applied to the receiving table 10 is detected by the load cell 15, and a force proportional to the extruded length of the extruded body and a holding force are generated based on that force. The reaction force is controlled by the servomotor 16 through the screw.

In the following, the present invention will be explained in more detail with reference to specific examples thereof. As a matter of course, it is evident that the present invention will not be limited to these examples.

EXAMPLE 1

This example is a case where the given length corresponds to that a single extruded body.

Six kg of methyl cellulose powder as a binder and 24 kg of water were fully kneaded with 100 kg of a raw material consisting of 100 parts by weight of a silicon nitride powder having the average particle diameter of 10 μm, and 8 parts by weight of magnesium oxide and 5 parts by weight of cerium oxide as a sintering aid in a kneader. Then, a vacuum-deaired billet of 180 mm(ϕ)x1000 mm(length) was prepared by using a vacuum pugmill. The obtained billet was fed to a cylinder of a 200 ton vertical-plunger type downwardly extruding machine. An extruding die having the minimum thickness of 0.7 mm and the maximum thickness of 12 mm was set at the lower side of the cylinder. The body was pressed down by a piston of the plunger extruding machine from the upper side. A shaped body extruded from the extruding die was in a shape of a rotor of an outer diameter of 150 mm(ϕ) for use in a pressure wave type supercharger.

The extruded body of 150 mm(ϕ) extruded through the die nozzle was received at the die nozzle by a receiving tray supported by a receiving table, and a force proportional to the extruded length of the extruded body and a holding force were applied to the receiving table by using a device which was driven in synchronization with the extruding speed of the shaped body. Thus, the extruded body having a length of 180 mm was formed while being supported by the receiving tray. After the extruding, the piston was stopped to interrupt the extruding operation.

Next, the extruded body was cut along the end face of the extruding die by a cutter of a thin wire to take out the extruded body having the length of 180 mm. The above-mentioned extruding operation was repeated, thereby obtaining numerous extruded bodies.

Thereafter, the thus obtained extruded bodies were placed in an electron range for 15 minutes, and hardened by heating. The hardened bodies were dried by blowing under heating in a hot-air drier for 20 hours. Opposite end portions of each of the thus dried bodies (green ceramic bodies) were cut off by a diamond cutter again to a total length of 150 mm. After a latex rubber film was deposited onto the cut body, it was hydraulically pressed at a pressure of 3 tons/cm$^2$. Then, the latex rubber was peeled off, the binder was removed by calcination at a temperature of 500° C. for 5 hours, and the calcined body was fired at 1,700° C. for 1 hour in an $N_2$ atmosphere, thereby obtaining a ceramic rotor for use in a pressure wave type supercharger.

The thus obtained ceramic rotors for use in the pressure wave type superchargers had an excellent dimensional precision, that is, a bending amount of not more than 1.0 mm and a roundness inside the range of ±1.0 mm (i.e., a total of not more than 2.0 mm).

EXAMPLE 2

This example is a case where the given length corresponds to that of two extruded bodies.

Six kg of methyl cellulose powder as a binder and 24 kg of water were fully kneaded by a kneader into 100 kg of a raw material consisting of 100 parts by weight of silicon nitride powder having the average particle diameter of 10 μm, and 8 parts by weight of magnesium oxide and 5 pars by weight of cerium oxide as a sintering aid, and a vacuum deaired billet of 180 mm(ϕ)x1,000 mm(length) was prepared from the mixture by using a vacuum pugmill. The body was fed to a cylinder of a 200 ton vertical-plunger type downwardly extruding machine. An extruding die having the minimum thickness of 0.7 mm and the maximum thickness of 12 mm was set at the lower side of the cylinder. A shaped body was extruded through the extruding die by pressing the billet with a piston of the plunger extruding machine from the upper side, and had a form of a rotor having an outer diameter of 150 mm(ϕ) for use in a pressure wave type supercharger.

The 150 mm(ϕ) extruded body having extruded through the die was received at the die surface by a receiving tray supported by a receiving table, and a force proportional to the extruded length of the extruded body and a holding force were applied to the receiving table by a device which was driven in synchronization with the extruding speed or the extruded body. While the extruded body was supported by the receiving tray, the extruded body having a length of 360 mm was formed. Then, the piston was stopped to interrupt the extruding operation. Next, the extruded body was cut in a length of 180 mm by a cutter of a thin wire, thereby taking out the extruded body. Then, the receiving tray was ascended to be brought into contract with the body. While the body was supported again by the receiving tray, another extruded body was formed in a length of 360 mm. Then, the piston was stopped to interrupt the shaping operation. The above-mentioned shaping operation was repeated, thereby obtaining numerous shaped bodies.

The succeeding heating and firing steps were effected under the same conditions as employed in Example 1, thereby obtaining ceramic rotors for use in pressure wave type superchargers.

The obtained ceramic rotors for use in the pressure wave type superchargers had excellent dimensional accuracy, that is, the bending amount of not more than 1.0 mm and the roundness inside the range of ±1.0 mm (i.e., a total of not more than 2.0 mm).

EXAMPLE 3

This example is a continuous extruding method.

Six kg of methyl cellulose powder as a binder and 24 kg of water were fully kneaded into 100 kg of a raw material consisting of 100 parts by weight of silicon nitride powder having the average particle diameter of 10 μm, and 8 parts by weight of magnesium oxide and 5 parts by weight of cerium oxide as a sintering aid by using a kneader, and a vacuum deaired billet of 180 mm(ϕ)x1,000 mm(length) was prepared from the mixture by a vacuum pugmill. The body was fed to a cylinder of a 200 ton vertical-plunger type downwardly extruding machine. An extrusion die having the minimum thickness of 0.7 mm and the maximum thickness of 12 mm was set to the lower side of the cylinder. A extruded body was extruded through the extruding die by downwardly pressing the body with a piston of the plunger extruding machine, and had a form of a rotor having an outer diameter of 150 mm(ϕ) for use in a pressure wave type supercharger.

The 150 mm(ϕ) extruded body through the die nozzle was received at the die surface by a receiving tray supported by a receiving table and a force proportional to the extruded length of the extruded body and a holding force were applied to the receiving table by using a device which was driven in synchronization with the extruding speed of the extruded body. While the body was supported by the receiving tray, the extruded body was extruded in a length of 180 mm, and was cut in the length of 180 mm at the end face of the die by a cutter of a thin wire. Then, the receiving table was immediately lowered, thereby taking out the extruded body.

The extruding operation was effected during the cutting and taking-out steps. Immediately after the extruded body was taken out, the receiving table and the receiving tray were raised to be brought into contact with the body being extruded and simultaneously support it. Then, the extruded body extruded was cut in a length of 180 mm by the thin wire cutter. Immediately thereafter, the receiving table was lowered again to take out the extruded body. The above-mentioned extruding operation was repeated, thereby obtaining numerous extruded bodies.

The succeeding heating and firing steps were effected under the same conditions as employed in Example 1, thereby obtaining ceramic rotors for use in pressure wave type superchargers.

The thus obtained ceramic rotors for use in the pressure wave type superchargers had excellent dimensional accuracy, that is, the bending amount of not more than 1.0 mm and the roundness of the inside the range of ±1.0 mm (i.e., a total of not more than 2.0 mm).

As mentioned above, according to the method and apparatus for extruding ceramic materials in the present invention, excellent dimensional accuracy and reduced unbalance of ceramic extruded products can be attained even in the case that the products have a relatively heavy weight and a smaller cell density, such as ceramic rotors for use in pressure wave type superchargers. Consequently, production cost of products can advantageously be reduced.

Also, extruded bodies having excellent dimensional accuracy can be obtained even in the case of large size ceramic honeycomb structural bodies having a diameter of more than 150 mm and large size ceramic honeycomb structural bodies having a minor axis of more than 150 mm. Thus, production cost of the products can advantageously be reduced.

What is claimed is:

1. A method of extruding a ceramic body, comprising the steps of:

extruding a ceramic material through an exit surface of an extrusion die in a substantially gravitationally downward direction to form an extruded ceramic body;

supporting the extruded body in a substantially gravitationally upward direction to prevent deformation thereof, by applying a reaction force consisting of a force proportional to an extruded length of the extruded body and a holding force in said upward direction from a lower end of the extruded body, while the extruded length of the extruded body or a numerical value proportional to the extruded length of the extruded body is being measured; and cutting the extruded body to a given length.

2. A method of extruding a ceramic body according to claim 1, wherein said reaction force is upwardly applied by synchronizing a moving speed of an extruded body receiving table for applying the reaction force to the extruded body as a function of an extruding speed of the extruded body.

* * * * *